US011892235B2

(12) United States Patent
Mealey et al.

(10) Patent No.: US 11,892,235 B2
(45) Date of Patent: Feb. 6, 2024

(54) METHOD AND SYSTEM FOR PROCESSING NATURAL GAS

(71) Applicant: CEMM Canada Limited, Calgary (CA)

(72) Inventors: Willard Brent Mealey, Calgary (CA); Anthony Hok Shing Wu, Calgary (CA)

(73) Assignee: CEMM CANADA LIMITED, Calcary (CA)

( * ) Notice: Subject to any disclaimer, the term of this patent is extended or adjusted under 35 U.S.C. 154(b) by 0 days.

(21) Appl. No.: 17/522,339

(22) Filed: Nov. 9, 2021

(65) Prior Publication Data

US 2022/0146194 A1 May 12, 2022

Related U.S. Application Data

(60) Provisional application No. 63/112,869, filed on Nov. 12, 2020.

(51) Int. Cl.
*F25J 3/02* (2006.01)

(52) U.S. Cl.
CPC ..... *F25J 3/0209* (2013.01); *F25J 3/0238* (2013.01)

(58) Field of Classification Search
CPC ..... F25J 3/0209; F25J 3/0238; F25J 3/0204; F25J 1/0022; F25J 1/0214; F25J 3/0233
See application file for complete search history.

(56) References Cited

U.S. PATENT DOCUMENTS

2010/0012809 A1* 1/2010 Zeng ..... F16M 11/10 248/351
2019/0049176 A1* 2/2019 Mccool ..... F25J 3/0209

* cited by examiner

*Primary Examiner* — Nael N Babaa
(74) *Attorney, Agent, or Firm* — Seed IP Law Group LLP

(57) ABSTRACT

Methods and systems for processing natural gas to meet gas pipeline specifications and/or recovering natural gas liquids (NGL). The natural gas is cooled and distilled such that propane and heavier components are produced as a bottoms NGL product, and inerts, methane, ethane, and other lighter portions are produced as a fuel gas grade/quality residue gas product stream. The gas can optionally be treated to remove hydrogen-sulfide and/or carbon dioxide. The NGL product can be split into a marketable propane and butane liquefied petroleum gas (LPG) liquid product and a natural gas condensate product.

6 Claims, 4 Drawing Sheets

PROCESS CONFIGURATION 'A'

PROCESS CONFIGURATION 'B'

PROCESS CONFIGURATION 'C'

METHOD AND SYSTEM FOR PROCESSING NATURAL GAS

TECHNICAL FIELD OF THE INVENTION

The present invention relates to natural gas processing methods and systems, and more particularly to methods and systems useful for processing raw stranded gas or what would otherwise be wasted flare gas.

BACKGROUND OF THE INVENTION

While natural gas is produced from gas fields using many prior art methods, it is known in the art that conventional oil wells may also produce natural gas to surface, known as associated gas. Since such associated gas is not the focus of the oil production operation, it presents a nuisance sometimes requiring extensive infrastructure to capture and monetize the asset but commonly with limited revenue potential. Even in some gas well operations, low-pressure gas may present challenges for producing the resource in a cost-effective manner, particularly where gas facilities are customized for the specific site.

Given the disincentives for attempting to monetize associated gas, it is common in many jurisdictions to waste the produced gas by simply flaring it and thus allow the operator to focus on the oil production activities. In jurisdictions where flaring is prohibited to any extent, however, an operator must attempt to capture at least some of the associated gas, which commonly involves construction and operation of expensive, complex facilities customized to the specific site. Furthermore, such site-specific facilities have limited flexibility in terms of inlet conditions and gas composition fluctuations, whereas associated gas can vary dramatically in composition and impurities which impacts gas facility design and necessitates flexibility.

What is needed, therefore, is a method and system for processing natural gas that can provide flexibility in handling different gas compositions and operating parameters.

SUMMARY OF THE INVENTION

Methods and systems according to the present invention can be used to capture raw stranded associated gas and/or associated gas that would otherwise be flared, or to process low-pressure gas, to produce natural gas liquids (NGL) and natural gas of a higher-value specification based on downstream market specifications and marketable as a compressed natural gas (CNG) product, as opposed to gas products that do not meet market specifications and are accordingly discounted and directed to lower-value markets or further processing.

According to a first aspect of the present invention, a system is provided for processing natural gas, the system comprising:

a compressor for compressing the natural gas into a compressed gas;

a cooling unit for cooling the compressed gas, a three-way valve downstream of the cooling unit;

an ethylene glycol regeneration unit for injecting ethylene glycol into the cooling unit;

a low-temperature gas-liquid phase separator for: separating the cooled compressed gas into a separator gas, a hydrocarbon liquid and a liquid water/ethylene glycol; directing the separator gas to the cooling unit before filtering and discharge to a natural gas product line as a natural gas product or after compression in a compressed natural gas compressor to a compressed natural gas line as a compressed natural gas product; directing the hydrocarbon liquid to at least one condenser for heating to form a heated hydrocarbon liquid; and directing the liquid water/ethylene glycol to the ethylene glycol regeneration unit;

a deethanizer comprising a top section and a bottom section; the top section configured to separate the heated hydrocarbon liquid into a top section gas and a top section liquid, the top section liquid sent to the bottom section; and the bottom section configured to separate the top section liquid into a bottom section gas and a bottom section liquid, the bottom section gas sent to the top section and the bottom section liquid sent to a natural gas liquids cooler, resulting in a natural gas liquids product for discharge to a natural gas liquids line;

the top section gas sent to the at least one condenser for cooling and condensing into a condenser liquid, the condenser liquid sent to an accumulator with an operating pressure maintained by an accumulator gas control valve, the accumulator separating the condenser liquid into an accumulator gas and an accumulator liquid; and the accumulator liquid sent to the top section, and the accumulator gas sent to the at least one condenser before being sent to the cooling unit before passing through the three-way valve to selectively direct the accumulator gas to either the natural gas product line for mixing with the natural gas product or to the compressor.

In some exemplary embodiments of the first aspect, the cooling unit comprises: at least one gas/gas exchanger for receiving the first compressed gas for pre-cooling to form a pre-cooled compressed gas; and at least one gas chiller for receiving the pre-cooled compressed gas and cooling the pre-cooled compressed gas to form the cooled compressed gas.

Exemplary systems may further comprise a two-phase separator upstream of the compressor for receiving an initial gas feed stream comprising water and the first gas, for separating the water from the first gas. A compressor bypass may also be incorporated into exemplary embodiments for use in the event that the natural gas is of sufficient pressure to not require compression. A low-pressure separator control valve is preferably provided downstream of the low-temperature gas-liquid phase separator selectively open or as a back pressure control.

According to second aspect of the present invention, a method for processing natural gas is provided, the method comprising the steps of: a. compressing the natural gas into a compressed gas;

b. cooling the compressed gas to form a cooled compressed gas;

c. injecting ethylene glycol into the cooled compressed gas;

d. separating the cooled compressed gas into a separator gas, a hydrocarbon liquid and a liquid water/ethylene glycol;

e. cooling and filtering the separator gas;

f. condensing and heating the hydrocarbon liquid;

g. regenerating ethylene glycol from the liquid water/ethylene glycol;

h. separating the heated hydrocarbon liquid into a first separated gas and a first separated liquid;

i. condensing and cooling the first separated gas;

j. heating the first separated liquid to separate it into a second separated gas and a second separated liquid;

k. cooling the second separated liquid to form a natural gas liquids product; and l. separating the condensed and cooled first separated gas into a third separated gas and a third separated liquid; condensing and cooling the third separated gas before selectively blending the third separated gas with the natural gas product or compressing the third separator gas.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Exemplary embodiments will now be described with reference to the accompanying drawings.

DETAILED DESCRIPTION OF EXEMPLARY EMBODIMENTS

Throughout the following description, specific details are set forth in order to provide a more thorough understanding to persons skilled in the art. However, well known elements may not have been shown or described in detail to avoid unnecessarily obscuring the disclosure. The following description of examples of the invention is not intended to be exhaustive or to limit the invention to the precise form of any exemplary embodiment. Accordingly, the description and drawings are to be regarded in an illustrative, rather than a restrictive, sense.

The present invention is directed to methods and systems for processing natural gas produced from subsurface geological formations or structures. A modularized process line-up allows for different valve operational arrangements to enable processing of different input gas compositions/pressures.

The inlet feed gas to the gas processing unit may come from the flare gas line outlet of an existing production facility or from a gas disposal line of a temporary well testing unit, although those skilled in the art will be aware of other gas sources that can benefit from embodiments according to the present invention. The feed gas composition to the gas processing unit varies depending on the source; for example, potential gas sources include flare gas, associated gas, and low pressure natural gas wells. Also, the gas contents are dependent on the source and can include, for example, other gases in various concentrations, such as hydrogen, helium, nitrogen and carbon dioxide. Possible feed stream contaminants include hydrogen sulfide and mercury. Commonly, water is present in the feed gas stream, as well. If contaminants are present prior to transferring the feed stream to the gas processing unit, the feed stream should be treated to substantially remove the contaminants in order to meet product specifications, and to protect the equipment in the plant.

Figure 1:
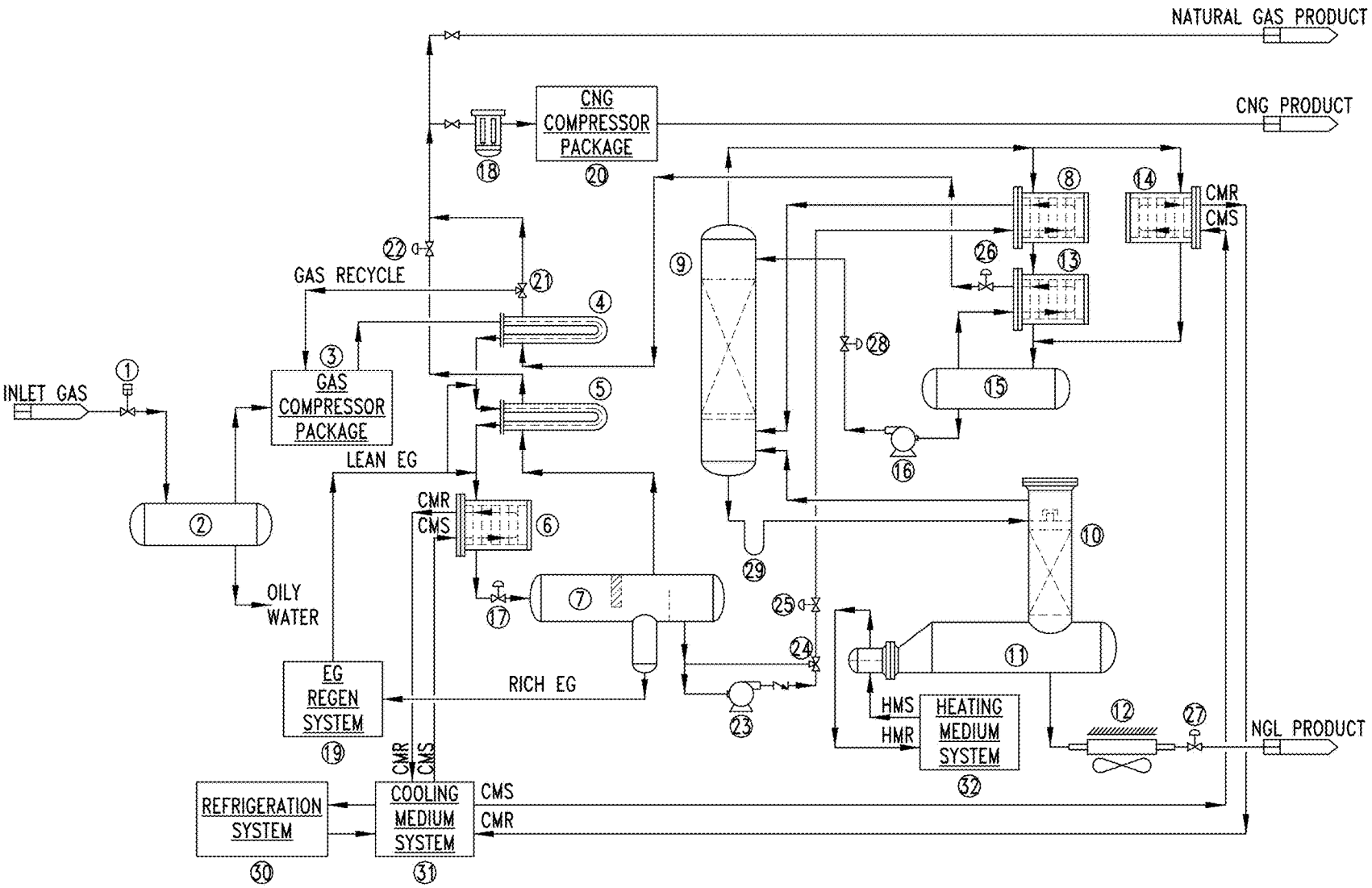
FIG. 1 is a diagrammatic process flow diagram according to an embodiment of the present invention.

Turning now to FIG. 1, a preferred embodiment of a gas processing unit according to the present invention is illustrated. For exemplary purposes only, a gas processing unit may be used to process the feed stream composition detailed in Table 1. In the present embodiment, the feed stream pressure is at 40 psig and the temperature at 100° F. For each application, the optimum operating temperatures and pressures at various locations in the process depend on the feed stream composition, plant inlet and outlet conditions, and the desired product recovery levels, as would be understood by those skilled in the art.

TABLE 1

Example Feed Stream Composition

| Component | Mole % |
|---|---|
| Nitrogen | 1.5200 |
| Carbon Dioxide | 0.6700 |
| Methane | 54.5700 |
| Ethane | 20.4900 |
| Propane | 12.5900 |
| iso-Butane | 1.6100 |
| n-Butane | 4.8500 |
| iso-Pentane | 1.0100 |
| n-Pentane | 1.4400 |
| n-Hexane | 0.9375 |
| n-Heptane | 0.3125 |
| Total | 100.0000 |

The inlet gas enters the inlet separator 2 through an inlet piping manifold consisting of an emergency shut down valve 1 and safety instrumentation. The inlet gas is assumed to be fully saturated with water. The inlet separator 2 in this embodiment is a two-phase horizontal separator vessel, which vessels are standard components in gas processing facilities, and its function is to remove any excess free water or hydrocarbon liquids from the inlet gas stream. The inlet separator 2 is installed with a vane-type mist eliminator to eliminate any entrained liquids in the gas stream. The oily water collected from the inlet separator 2 will normally be stored and then discharged by trucking out of the facility for further treatment.

The separated gas stream from the inlet separator 2 is then fed to a gas compressor package 3, which can be a commercially available component such as the NOMAD™ compressor sold by Bidell Gas Compression (a division of Total Energy Services). The gas compressor package 3 will preferably be a three-stage gas-engine-driven reciprocating unit. The outlet gas at 40 psig from the inlet separator 2 and the recycle gas stream from the deethanizer-top section 9 (described below) will enter the first stage suction scrubber of the compressor 3. Any free liquids collected from the scrubbers are dumped into a closed drain system. The gas flows up through a mist eliminator in the scrubber, which removes any entrained liquid in the gas stream before entering the suction of the first stage cylinder. The gas is compressed and flows to a first stage discharge cooler where it is cooled to 110° F. Gas from the first stage discharge cooler flows to a second stage suction scrubber and this compression process is repeated for the second and third stage of compression, as well as the second and third stage after coolers, which have final discharge pressures of up to 800 psig. Any interstage liquid drop-out will be discharged to the closed drain system. The gas compressor units operates on speed control, with the suction pressure controlled by a recycle valve from the discharge header. This can function to maintain a minimum suction pressure and keep the unit from shutting down on low suction pressure. There are manual suction and discharge isolation valves provided upstream of the suction scrubber and downstream of the final after-cooler. All stages will have pulsation bottles on the suction and discharge to reduce the effect of pulsation on the flow, in and out of the stages.

If the source gas is sufficiently high-pressure, then the gas compressor 3 may not be required or can be by-passed. Most associated gas flows from the well(s) or oil battery at relatively low pressure, but some gas sources are relatively high-pressure (for example, 600 psig to 1100 psig) and may not require inlet compression.

Discharged gas from the gas compressor package 3 flows through, in series, to a gas/gas exchanger 4 and a gas/gas exchanger 5 to pre-cool the gas by exchanging heat with the residue gas and recycle gas streams. The gas/gas exchanger 4 cools the inlet gas stream to 105° F. by exchanging heat with the recycle gas from a deethanizer reflux condenser 13. The gas/gas exchanger 5 cools the inlet gas stream to 36° F. by exchanging heat with the residue gas from a low-temperature separator 7 (described below).

The cooled gas stream flows through gas chillers 6 to further cool the stream to −14° F. by exchanging heat with a cooling medium system 31, which cooling medium system 31 is operably connected to a refrigeration system 30 (described below). A commercially available industrial chiller (normally not used in the oil and gas industry as a refrigeration system) is used to cool a coolant, which coolant is circulated in a closed-loop system through the gas chillers 6. The chilled process stream then goes through a Joule Thompson (J-T) valve 17 (a control valve, whereby when the gas pressure drops across the valve 17 the released energy cools the gas to a lower temperature through the Joule Thompson effect) to achieve a much colder temperature (approx. −40° F.) before flowing to the low-temperature separator 7. The gas temperature reduction results in hydrocarbon liquid condensation as well as water condensation. The water is generally removed as hydrates in this process; as the gas cools, water and hydrocarbons form hydrates, and ethylene glycol is injected into the heat exchangers which absorbs the hydrates and can then be separated in the low-temperature separator 7. Effectively, the gas is dehydrated in addition to achieving some hydrocarbon liquid recovery. Since the gas is cooled to lower than the water dew point, lean ethylene glycol (EG) is injected into the gas stream at the inlet of the gas/gas exchangers 4, 5 and chillers 6. The liquid hydrocarbons that are extracted from the gas are removed in the low-temperature separator 7 (which is a three-phase separator that separates gas, hydrocarbon and water/glycol phases).

The low-temperature separator 7 is a three-phase horizontal vessel which provides liquid retention to separate the two liquid phases and gas. The glycol/water mix (rich EG) separated out of the low-temperature separator 7 is sent to a commercially-available ethylene glycol (EG) regeneration unit 19 while the hydrocarbon liquid stream is sent to the deethanizer-top section 9 through a deethanizer reflux condenser/exchanger 8.

The residue gas separated at the low-temperature separator 7 is diverted to the gas/gas exchanger 5 for cooling and then sent to a residue gas filter separator 18 to remove impurities and recover any liquids carry over in the residue gas. Liquid droplets that carry over in the gas phase are separated by gravity and a wire-mesh mist extractor inside the low-temperature separator 7, and the residue gas filter separator 18 uses coalescing elements to enlarge liquid droplets that can then be removed. Clean gas from the residue gas filter separator 18 is discharged as a natural gas product which can be sent to an export pipeline or to a compressed natural gas (CNG) compressor package 20 for transport to the gas market using high-pressure CNG tube trailers.

The hydrocarbon liquid from the low-temperature separator 7 is discharged via a low-temperature separator liquid level control valve 25 with the option of using an NGL transfer pump 23 to boost the pressure depending on the operating requirements of the system to achieve the target recovery rate. A three-way diverter valve 24 and a bypass line configuration is provided in this liquid line to add flexibility to the system. The hydrocarbon liquid from the level control valve 25 is then pre-heated in the deethanizer reflux condenser/exchanger 8 and then fed into the deethanizer-top section 9 for stabilization.

Discharge gas from the deethanizer-top section 9 is fed back to the deethanizer reflux condenser/exchanger 8 and a deethanizer reflux condenser 14 for cooling and condensing the required reflux stream. The deethanizer reflux condenser 14 is cooled by the cooling medium system 31 to ensure that the target cooling temperature is achieved. To recover available cooling duty and enhance efficiency of the system, the stream exiting the deethanizer reflux condenser/exchanger 8 is further cooled in the deethanizer reflux condenser 13.

The condensed liquids are separated from the gas in a deethanizer reflux accumulator 15. The condensed liquids from the deethanizer reflux accumulator 15 are pumped back by a deethanizer reflux pump 16 through a liquid level control valve 28 to the top tray of the deethanizer-top section 9 column. The operating pressure in the deethanizer reflux accumulator 15 is maintained using a back pressure valve 26 and can be adjusted to maximize product recoveries.

The vapor from the deethanizer reflux accumulator 15 passes through the deethanizer reflux condenser 13 for pre-heating and flows to the gas/gas exchanger 4 to warm up the gas. Depending on the quality, the gas exiting the gas/gas exchanger 4 can be blended with the natural gas product stream or it can be diverted back to the inlet of the gas compressor package 3 as the recycle gas. The recycle gas can also be used as fuel gas for the facility itself. A three-way diverter valve 21, a back pressure valve 22, and a bypass line configuration is provided in this gas line to add flexibility to the system.

Liquids from the deethanizer-top section 9 flow by gravity through a liquid line comprising a trap 29 to a deethanizer-bottom section 10, the trap 29 serving to prevent vapour from flowing up the liquid line to the deethanizer-top section 9. The hydrocarbon liquid that passes through the trays of the deethanizer-bottom section 10 is heated to 145° F. by a deethanizer reboiler 11 which is heated by a heating medium system 32. Formed vapor from the deethanizer reboiler 11 returns to the deethanizer-bottom section 10 column and continues to flow to the deethanizer-top section 9 column, while the NGL product from the bottom of the deethanizer-bottom section 10 goes to a C3+ NGL product cooler 12. Liquid level at the deethanizer reboiler 11 is maintained by a level control valve 27 installed downstream of the NGL product cooler 12. The NGL products may be metered and stored in NGL product storage tanks for distribution or export.

A mix of ethylene glycol and water (80/20 wt %) is utilized as the coolant in the cooling medium system 31 to refrigerate the inlet natural gas in the gas chillers 6. The cooling medium is also used for the deethanizer reflux condenser 14. The typical process scheme for the cooling medium system 31 involves closed loop circulation of coolant returning from the gas chillers 6 and condensers 8, 13, 14, entering a fuel-gas-blanketed horizontal coolant surge tank, and the coolant is then pumped by coolant circulation pumps to a refrigeration system trailer where it is cooled to −26° F. by exchange heat against refrigerant in a coolant chiller. The cooled coolant returns to the gas chillers 6, deethanizer reflux condenser 8 and other components in a closed-loop manner.

The refrigeration system 30 comprises commercially-available "plug and play" modules selectable depending on the inlet gas compositions and applications of the refrigeration load. The refrigerant which cools the coolant goes through a typical closed-cycle refrigeration loop with one or multiple trains of refrigeration units depending on cooling load requirements. Each train comprises a heating/evaporation phase produced by heat exchange against the coolant in the coolant chiller, a compression phase performed by the refrigerant compressors (variable-speed, screw-type), a cooling/condensing phase in the refrigerant condensers (air coolers) and a pressure drop phase before completing the loop by returning to the coolant chiller. Refrigerant lube oil separator, refrigerant lube oil filters, and refrigerant compressor lube oil pumps are also provided for each loop.

The rich glycol removed from the low-temperature separator 7 is sent to the ethylene glycol (EG) regeneration unit 19. The EG regeneration unit 19 boils and strips the water-rich glycol, removing some of the water mixed with the glycol to increase the glycol concentration back to 80 wt % in a closed-loop regenerative cycle, to achieve a lean glycol purity of 80/20 wt %.

A typical process scheme for the EG regeneration unit 19 involves circulating the rich glycol discharged from the low-temperature separator 7. The rich glycol solution initially enters the cool side of an ethylene glycol lean/rich exchanger where it is heated by the lean glycol leaving a glycol regenerator reboiler. The solution then enters an EG regenerator still tower which is a packed distillation column. A regeneration condenser comprising a vertical, coiled-tube circulating coolant, is provided at the top of the glycol still column to condense some liquids out of the vapor stream exiting the still column and being sent to flare. Liquids flow back down the column. At the bottom of the regenerator, the temperature of the glycol is elevated in the reboiler by exchange with a heat medium to evaporate water. The boiled-off water and hydrocarbon vapor pass upward through the still column. The glycol surge tank section of the EG regenerator 19 acts as an expansion and storage vessel for the glycol system. The glycol surge tank is constructed integral with the EG regenerator/reboiler. Lean glycol exits the bottom of this vessel and enters the hot side of the EG lean/rich exchanger. In this exchanger, the lean glycol is cooled down before going to the suction of EG circulation pumps. The EG circulation pumps are electrically-driven, reciprocating, plunger-type pumps and boost the glycol pressure to the level required for re-injection into the main NGL recovery process, upstream of the exchangers 4, 5. An EG filter followed by an EG carbon filter are provided upstream of the injection points to remove trace impurities.

A 60/40 wt % ethylene glycol/water mixture is used as the heat medium to supply the heating required in the deethanizer reboiler 11, the EG regenerator reboiler, and the heating coils of the low-temperature separator 7 to keep the system stable. The heat medium is circulated in a closed loop which consists of a direct-fired heat medium heater, heat medium system pumps and a nitrogen blanketed heat medium expansion tank.

The general process arrangement, as illustrated in FIG. 1, is flexible to enable operation with a wide range of gas compositions and inlet conditions. Depending on the gas composition and inlet conditions the system can provide for a balance of several multi-thermal design heat integration means, plus function in numerous multi-process scheme configurations. The general process arrangement allows optimization of heat duty balance between heat condensers/exchangers 8, 13, 14 and 4 depending on the application. The following process configurations are intended to improve product recoveries for individual field cases depending on the gas compositions and available pressure from the source gas.

Figure 2:
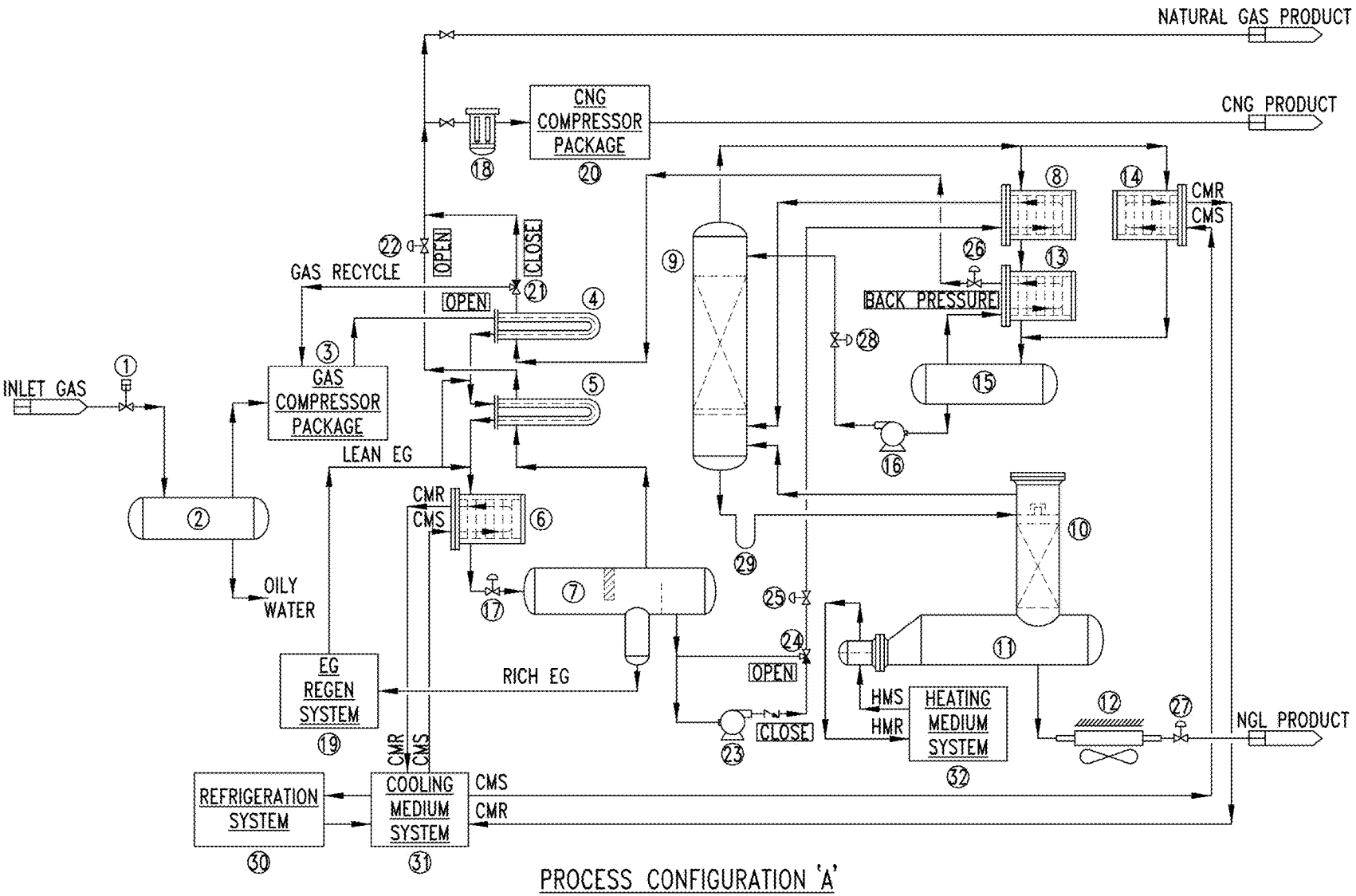
FIG. 2 is the embodiment of FIG. 1 with the process scheme configured to recycle the gas from the deethanizer reflux accumulator with the reflux accumulator gas control valve operating on back pressure control.

Referring to FIG. 2 (Process Configuration 'A'), this mode of operation is configured to recycle the gas from the deethanizer reflux accumulator 15 with the reflux accumulator gas control valve 26 operating on back pressure control. The 3-way valve 21 directs flow of gas from the gas/gas exchanger 4 to the gas recycle line joining the inlet of the gas compressor package 3. The low-temperature separator gas control valve 22 is kept fully open and the 3-way valve 24 downstream of the low-temperature separator 7 is on bypass, with the fluid line around the transfer pump 23 closed and the reflux accumulator gas control valve 26 on back pressure control. This configuration can be used to process rich gas streams where maximum NGL recovery can be achieved.

Figure 3:
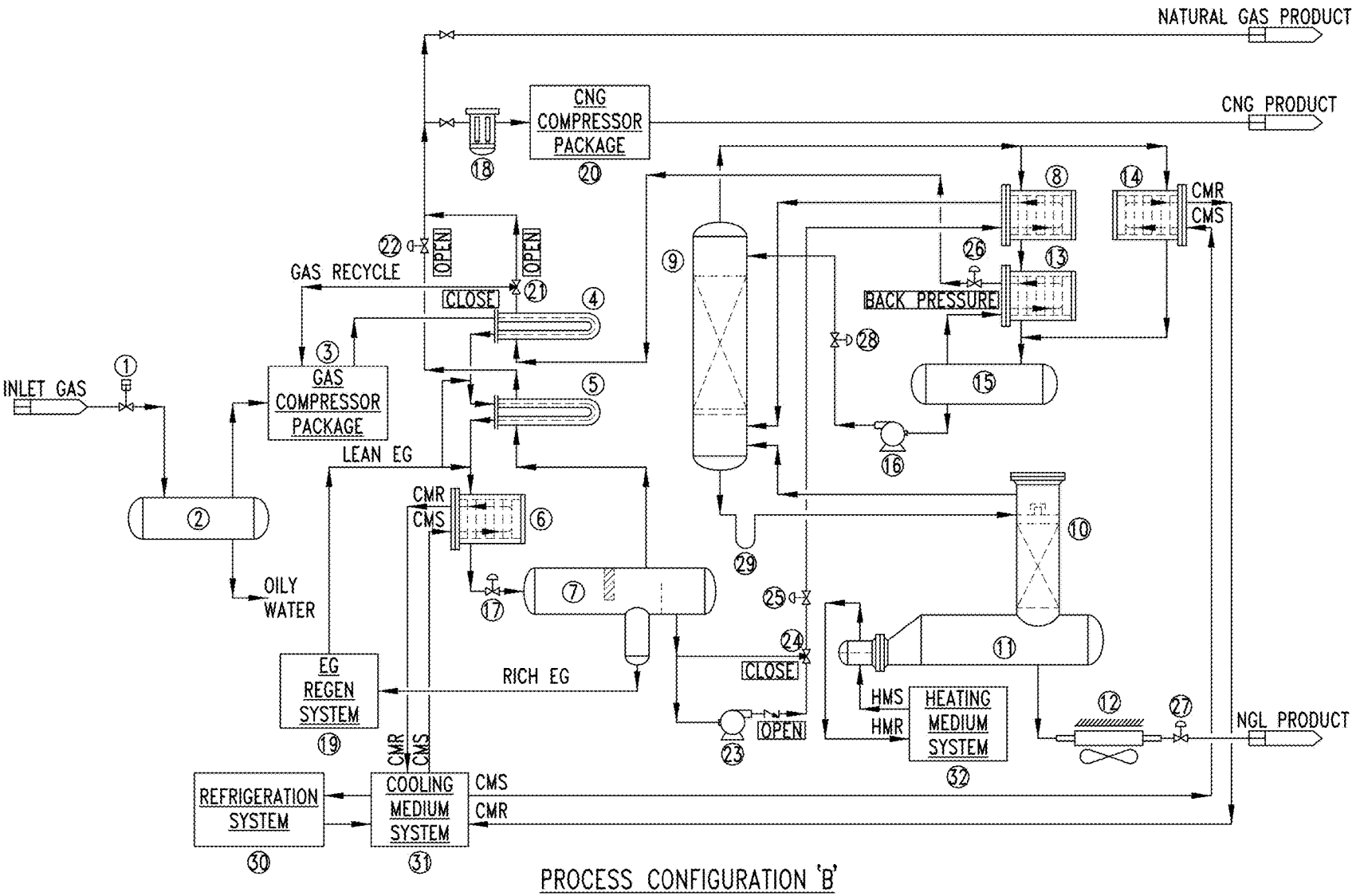
FIG. 3 is the embodiment of FIG. 1 with the process scheme configured to blend/mix the gas from the deethanizer reflux accumulator with the natural gas product while the reflux accumulator gas control valve is operating on back pressure control.

Referring to FIG. 3 (Process Configuration 'B'), this mode of operation is configured to blend/mix the gas from the deethanizer reflux accumulator 15 with the natural gas product while the reflux accumulator gas control valve 26 is operating on back pressure control. The 3-way valve 21 directs flow of gas from the gas/gas exchanger 4 to mix/blend with the natural gas product line while the gas recycle line is kept closed. The low-temperature separator gas control valve 22 is kept fully open and the 3-way valve 24 downstream of the low-temperature separator 7 directs the flow to the transfer pump 23 so the liquid can be discharged to the deethanizer-top section 9. This configuration can be used to process lean gas streams to maximize on-specification natural gas production.

Figure 4:
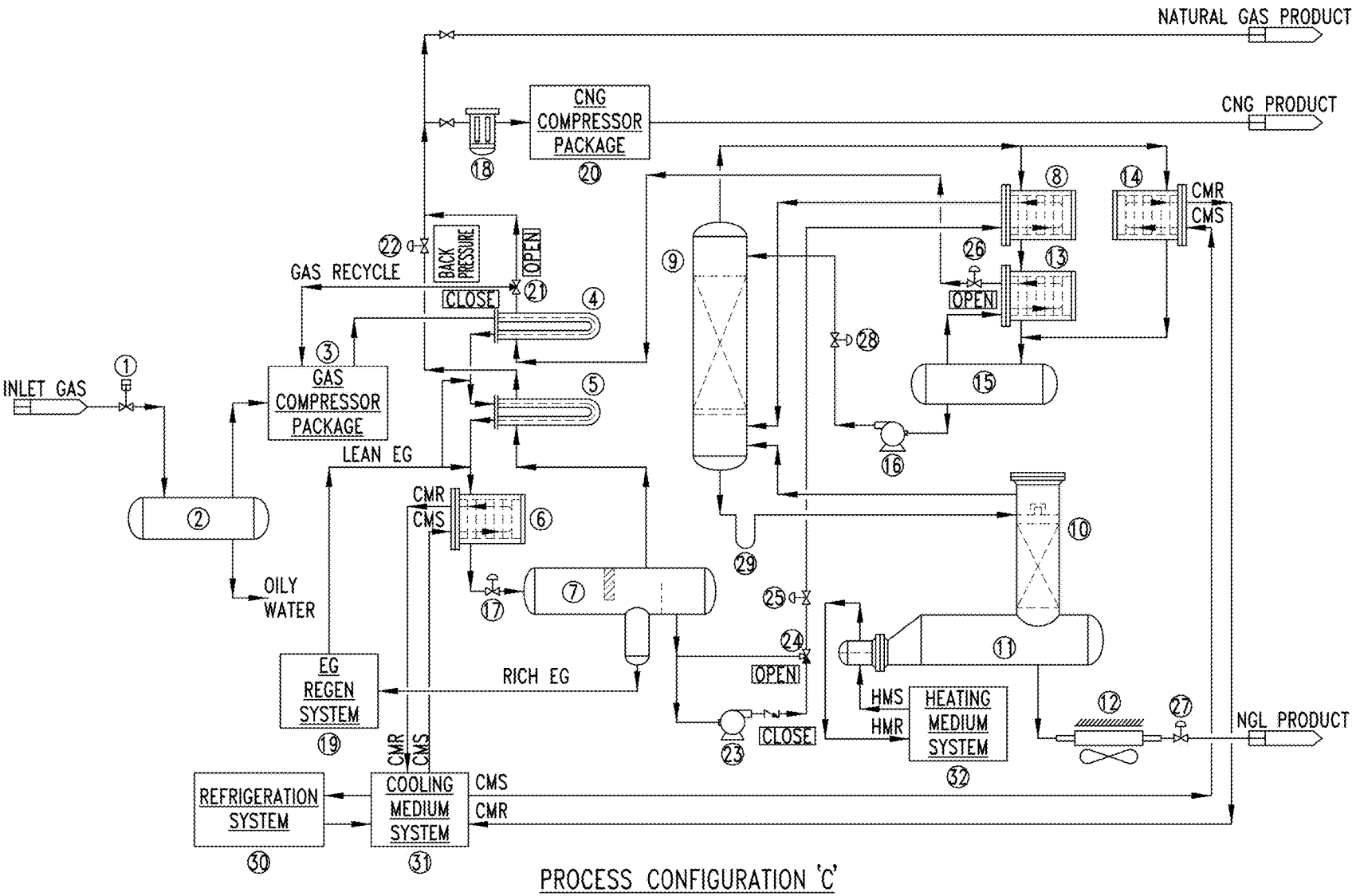
FIG. 4 is the embodiment of FIG. 1 with the process scheme configured to blend/mix the gas from the deethanizer reflux accumulator with the natural gas product while the reflux accumulator gas control valve is fully open and the low-temperature separator gas control valve is operating on back pressure control.

Finally, referring to FIG. 4 (Process Configuration 'C'), this mode of operation is configured to blend/mix the gas from the deethanizer reflux accumulator 15 with the natural gas product while the reflux accumulator gas control valve 26 is fully open and the low-temperature separator gas control valve 22 is operating on back pressure control. The 3-way valve 21 directs flow of gas from the gas/gas exchanger 4 to mix/blend with the natural gas product line while the gas recycle line is kept closed. The low-temperature separator gas control valve 22 operates on back pressure control and the 3-way valve 24 downstream of the low-temperature separator 7 is on bypass, with the fluid line around the transfer pump 23 closed. The reflux accumulator gas control valve 26 is kept fully open. Depending on the source gas composition, this configuration can be used to process either lean or rich gas streams to optimize production between product gas and NGL product.

The foregoing is considered as illustrative only of the principles of the present invention. The scope of the claims should not be limited by the exemplary embodiments set forth in the foregoing, but should be given the broadest interpretation consistent with the specification as a whole.

The invention claimed is:

1. A system for processing natural gas, the system comprising:

a first compressor for compressing the natural gas into a compressed gas;

a cooling unit for cooling the compressed gas;

a three-way valve downstream of the cooling unit;

an ethylene glycol regeneration unit for injecting ethylene glycol into the cooling unit;

a low-temperature gas-liquid phase separator for: separating the cooled compressed gas into a separator gas, a hydrocarbon liquid and a liquid water/ethylene glycol; directing the separator gas to the cooling unit before filtering and discharge to a natural gas product line as a natural gas product or after compression in a second compressor to a compressed natural gas line as a compressed natural gas product; directing the hydrocarbon liquid to at least one condenser for heating to form a heated hydrocarbon liquid; and directing the liquid water/ethylene glycol to the ethylene glycol regeneration unit;

a deethanizer comprising a top section and a bottom section; the top section configured to separate the heated hydrocarbon liquid into a top section gas and a top section liquid, the top section liquid sent to the bottom section; and the bottom section configured to separate the top section liquid into a bottom section gas and a bottom section liquid, the bottom section gas sent to the top section and the bottom section liquid sent to a natural gas liquids cooler, resulting in a natural gas liquids product for discharge to a natural gas liquids line;

the top section gas sent to the at least one condenser for cooling and condensing into a condenser liquid, the condenser liquid sent to an accumulator with an operating pressure maintained by an accumulator gas control valve, the accumulator separating the condenser liquid into an accumulator gas and an accumulator liquid; and the accumulator liquid sent to the top section, and the accumulator gas sent to the at least one condenser before being sent to the cooling unit before passing through the three-way valve to selectively direct the accumulator gas to either the natural gas product line for mixing with the natural gas product or to the compressor.

2. The system of claim 1 wherein the cooling unit comprises:

at least one gas/gas exchanger for receiving the compressed gas for pre-cooling to form a pre-cooled compressed gas; and at least one gas chiller for receiving the pre-cooled compressed gas and cooling the pre-cooled compressed gas to form the cooled compressed gas.

3. The system of claim 1 further comprising a two-phase separator upstream of the first compressor for receiving an initial gas feed stream comprising water and gas, for separating the water from the initial gas feed stream.

4. The system of claim 1 further comprising a first compressor bypass for use in the event that the natural gas is of sufficient pressure to not require compression.

5. The system of claim 1 further comprising a low-pressure separator control valve downstream of the low-temperature gas-liquid phase separator selectively open or as a back pressure control.

6. A method for processing natural gas, the method comprising the steps of:

a. compressing the natural gas into a compressed gas;

b. cooling the compressed gas to form a cooled compressed gas;

c. injecting ethylene glycol into the cooled compressed gas;

d. separating the cooled compressed gas into a separator gas, a hydrocarbon liquid and a liquid water/ethylene glycol;

e. cooling and filtering the separator gas;

f. condensing and heating the hydrocarbon liquid;

g. regenerating ethylene glycol from the liquid water/ethylene glycol;

h. separating the heated hydrocarbon liquid into a first separated gas and a first separated liquid;

i. condensing and cooling the first separated gas;

j. heating the first separated liquid to separate it into a second separated gas and a second separated liquid;

k. cooling the second separated liquid to form a natural gas liquids product; and l. separating the condensed and cooled first separated gas into a third separated gas and a third separated liquid; condensing and cooling the third separated gas before selectively blending the third separated gas with the natural gas product or compressing the third separator gas.

* * * * *